United States Patent [19]

Lamort

[11] 4,369,093

[45] Jan. 18, 1983

[54] PROCESSES AND DEVICES FOR THE DISINTEGRATION OF CELLULOSE MATERIALS

[75] Inventor: Jean P. Lamort, Vitry le Francois, France

[73] Assignee: E et M Lamort (Societe Anonyme), Vitry le Francois, France

[21] Appl. No.: 90,985

[22] Filed: Nov. 5, 1979

[30] Foreign Application Priority Data

Nov. 17, 1978 [FR] France ..... 78 32549

[51] Int. Cl.[3] ..... D21C 9/00

[52] U.S. Cl. ..... 162/246; 162/261; 241/73; 241/79; 241/97

[58] Field of Search ..... 162/261, 28, 52, 246; 241/68, 79, 97, 80, 57, 32, 46.17, 73; 209/211

[56] References Cited

U.S. PATENT DOCUMENTS 3,617,433 11/1971 Sutherland ..... 162/28

*Primary Examiner*—Peter Chin

*Attorney, Agent, or Firm*—Darby & Darby

[57] ABSTRACT

A process is provided for the removal from paper pulp of impurities, the pulp being contained in a pulping machine. Some of the pulp is periodically transferred into an enclosed chamber annexed to the pulping machine, the chamber having a volume which is small compared to the volume of the pulping machine. The pulp in the chamber is stirred and separated by a rotor, and fibre suspension is returned to the pulping machine, dilution water being introduced into this chamber. The chamber is emptied and impurities thereafter discharged.

15 Claims, 5 Drawing Figures

22
17
18a
22

26
25
24
23
12

PROCESSES AND DEVICES FOR THE DISINTEGRATION OF CELLULOSE MATERIALS

BACKGROUND AND FIELD OF THE INVENTION

In the paper-making industry, machines called "pulp machines" or "pulpers" prepare the paper pulp by breaking down cellulose materials which can be totally or partly materials to be recycled, such as old papers, boxes etc. In order to achieve this, the pulping machine is made of a fixed, open tub having a rotor in the form of a turbine. This tub is filled with water and with a certain amount of cellulose materials, and the rotor is then started up. The rotor causes energetic stirring of the water and the disintegration of the cellulose material which occurs in the form of dispersion or of a suspension and is discharged through perforations provided in the bottom of the tub.

In the standard kind of pulping machines, the concentration of dry cellulose materials has to remain quite weak, below 7% and generally about 5%, since otherwise the suspension is not liquid enough to be able to flow away and be discharged through the perforated sheet of metal forming the grating which usually surrounds the turbine.

In spite of this dilution, the discharge grating gradually becomes blocked up, as much by foreign bodies which are mixed with the cellulose material (clips, iron wires, string, etc) as by pieces of cellulose which have still not been broken down. Thus it is necessary to stop the pulping machine and to empty it, which involves a break in the production and a great loss of material, as well as being a source of pollution resulting from the disposal of these remnants.

In practice, the pulping machine is started up and it is interrupted when the flow of the discharged suspension falls below a certain value. The pulping machine is then half empty, which for a pulping machine of 30 $m^3$ represents 15 $m^3$ of the suspension with 5% of dry material, that is about 750 kg of dry material containing about 10% to 15% of impurities and 85% of good fibre. If the pulping machine is stopped and emptied three times in 24 hours, this means a loss of 1.3 tons of good fibre for 200 kg of impurities.

These figures explain the existing interest in trying to recover this fibre and avoid the pollution which results by its rejection.

SUMMARY OF THE INVENTION

The subject of the invention is a process and a device for resolving these problems.

The process according to the invention consists in regularly taking out a determined volume of the pulp filled with impurities contained within the pulping machine, stirring this pulp while progressively diluting it and at the same time extracting the fibre suspension which is recycled in the pulping machine, in order finally to empty the said volume when its fibre content is below a chosen value, up to the point where there only remains an impurity residue which is rejected.

This pulp transfer is preferably carried out in an enclosed volume of which the capacity does not exceed one tenth of that of the pulping machine and the discharge of this volume is brought about by introducing compressed air.

The device according to the invention consists of an enclosed volume annexed to the pulping machine, having a lateral stirring means and means for separation and of recycling by the pulping machine of the suspension of fibres, a pulp inlet controlled by a valve and connected to the lower part of the pulping machine, a bottom outlet for reject material, as well as a water inlet and a compressed air inlet.

Separation is preferably ensured by arranging the disc of the rotor set back with regard to the surface of the enclosed volume on which it is assembled, so as to define an extraction gap.

The enclosed volume is preferably in the general shape of a surface of revolution about a horizontal axis or an axis slightly inclined to the horizontal, terminated by two flat vertical sides or almost vertical sides, at the lower part of one of these is assembled the rotor of the enclosed volume.

Behind the rotor of the enclosed volume there is an impervious box which communicates with the pulping machine.

The axis of the enclosed volume is slightly inclined towards this rotor and the outlet of the impurities is arranged at the lower part of the enclosed volume near the rotor in order to make a receptacle for the impurities.

Means are provided to ensure in a cyclic fashion the communication of the pulping machine and of the enclosed volume, the introduction of the water, the emptying of the enclosed volume and the extraction of the impurities.

The rotor has bars which cooperates with the grooves carried by the opening which is provided in the side on which is assembled the rotor.

DETAILED DESCRIPTION OF PREFERRED EMBODIMENTS

Figure 1:
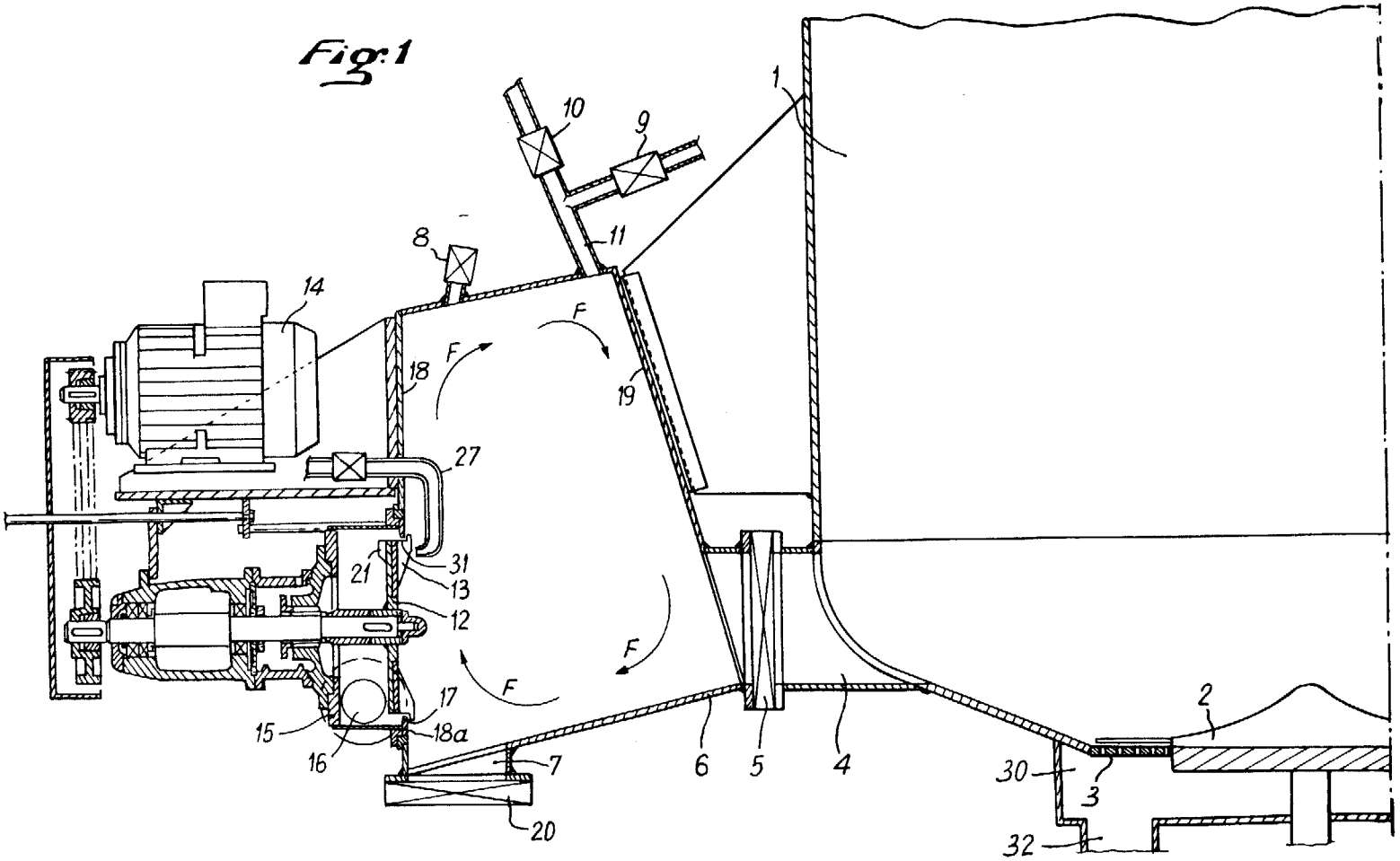
FIG. 1 is a view of an axial vertical section of a device according to the invention.

FIG. 1 shows a tub 1 of a standard type of pulping machine, working while open, with an average concentration of from 2 to 7% of dry material. The rotor of the pulping machine is in simplified form in FIG. 2.

The rotor 2 is in known manner, surrounded with a perforated grating 3 which is connected with a receptacle 30 which is provided with a discharge 32 for the fibre suspension constituting the pulp which is finally accepted. These parts are not shown in detail since they are known.

On the other hand, according to the invention, the tub 1 has an outlet 4 combined with a valve 5 and situated at the lower part of the pulping machine. This outlet 4 leads to a volume 6 which is an entirely enclosed volume and is small compared to the volume of the tub 1.

This volume has, in addition to the inlet 4 which is controlled by the valve 5, a low outlet 7 for rejected material, which is controlled by a valve 20, a water inlet 8, a compressed air inlet 9, and a gas outlet 10, these last two mentioned communicating with the volume 6 either separately or via a common channel 11. The volume 6 also has a rotor 12 with blades 13 driven by a motor 14, an impervious box 15 behind the rotor 12, and an outlet 16 at the lower part of the box 15, communicating with the tub 1.

The rotor 12 is made from a plate provided with blades or vanes 13, the surface of the plate 12 being set back in relation to the surface 18 of the volume 6 so as to define a gap 31, of predetermined dimensions, for the passage of the fibre suspension. The opening 17 of the side 18 of the volume 6 has a diameter which is substantially equal to that of the plate 12 and the gap 31 is approximately in the range of from 5 to 10 mm in thickness.

The process according to the invention is as follows. The tub 1 is filled with water and with cellulose materials in the usual proportions (about 5% of dry cellulose materials) and the rotor 12 is put into operation.

At the end of an interval of time during which the pulp is disintegrated and discharged through discharge 32, the openings of the grating 3 begin to become congested and the discharge flow in receptacle 30 and discharge 32 diminishes.

The valve 5 is then opened and, the motor 14 at this stage being in operation, the volume 6 fills up, via the outlet 4 with a fibre suspension filled with impurities. This moving of the impurities which have accumulated on the grating 3 is ensured by the centrifugal effect of the rotor 2 at the bottom of the pulping machine 1 and by the suction of the rotor 12 which acts like a pump.

The suspension which penetrates thus into the volume 6 undergoes a violet mixing and separation, the impurities remaining in the volume 6, while the decontaminated suspension penetrates, by the action of the rotor 12 and by the gap 31, into the box 15 to be returned to the tub 1.

After some time, which can be in the range of some minutes, it is established that the gap 31 is beginning to become congested and the rate of the extraction of the suspension drops. The valve 5 is then closed and the water inlet 8 is opened, which causes a progressive dilution of the pulp situated in the volume 6.

This phase can last for from 5 to 15 minutes, although these figures are not given by way of limitation. The phase is interrupted when the concentration of cellulose materials in the water which leaves through outlet 16 falls to the region of 1%.

Next the gas outlet 10 is closed and the compressed air inlet 9 is opened. Volume 6 empties by the action of the compressed air up to a point where its level reaches the lower part of the opening 17.

During this phase, the very diluted suspension contained in the volume 6 is continually thrown by the rotor 12 on to the sides of the latter which are washed in this way, and the impurities accumulate in the outlet 7.

After this phase, which likewise lasts a few minutes, the compressed air inlet 9 is closed, the rejection valve 20 is opened and the impurities are rejected.

A new cycle such as the one described above can then be started up.

Using this process and this arrangement, the following results are obtained. The impurities discharged past outlet 7 contain practically no fibres and are made up of pieces of plastic, glass, wood, metal, string etc. This decreases the pollution considerably and indicates a high degree of recovery of fibres.

The operating of the pulping machine is not interrupted. The tub 1 is replenished either continuously or discontinuously. The process and the device practically only use up the power of the motor, and the dilution water discharged into the volume 6 can be recycled water, commonly referred to as production water, which results from the draining or the concentration of the pulp. This water contains charges, paste, fibrils, dye etc., which do not spoil the process.

The power consumption of the motor is compensated for by the recovery of cellulose materials and by the economy which results from the avoidance of interruptions.

For an effective operation of the device and of the process, a certain number of arrangements and complementary means are provided:

(a) Volume 6 is preferably in the shape of a section of a cylinder or a cone with its axis slightly inclined to the horizontal in the direction of the rotor 12.

(b) The rotor 12 is situated in the lower zone of one level side 18 which terminates volume 6.

(c) The end and opposite side 19 makes an open dihedral with the side 18 towards the bottom.

(d) The side 18 is approximately vertical and the side 19 approximately perpendicular to the axis of volume 6.

(e) The outlet 7 is situated so that it constitutes a cavity or a receptacle above the valve 20 which controls it.

(f) The outlet 16 is at a lower level at the lower part of the opening 17.

The objective and the advantages of these arrangements are as follows:

While the rotor 12 turns, it produces a stirring of the suspension which involves a general rotation movement around the axis of volume 6 and a movement according to the arrows F. The rotation movement ensures a continuous washing of the lateral side of volume 6, a washing which is very efficient when this side is a surface of revolution. The movement according to the arrows F ensures the cleaning of the higher parts of volume 6, notably during the emptying phase of the latter, the water being thrown violently onto the sides and notably onto the high angles. The trapezium shape of the vertical section of volume 6 ensures a better cleaning of the high angles.

The feature of the bottom of volume 6 being slightly inclined towards the rotor ensures a better back flow of the impurities towards the rotor 12 and the outlet 7.

The impurities are thrown by the rotor 12 against the side of volume 6; the arrangement of the outlet 7 in the shape of a receptacle in the lower part near the rotor, forms a kind of trap for the impurities, which accumulate and are wedged in the receptacle and do not move in spite of the violent movement of the water. Moreover, behind the rotor 12, blades 21 have been provided which ensure excess pressure in the box 15 and by this, ensure the back flow of the suspension via the outlet 6 towards the tub 1, the rotor 12 functioning as a pump.

The rotor 12 can be produced in different ways. In the example of FIG. 1, it is a single component made of a plate carrying radial vanes 13.

The assembly of rotor 12, box 15 and motor 14 forms a unit assembled on the side 18, this assembly having an annular sheet of metal 18*a* in which the opening 17 is made. Thus, this assembly can be removed as a unit. Moreover, the gap between the rotor plate and sheet 18*a* is adjustable or regulatable, which enables it to be adapted to the materials which are to be treated. The edge of the opening 17 is chamfered.

Figure 2:
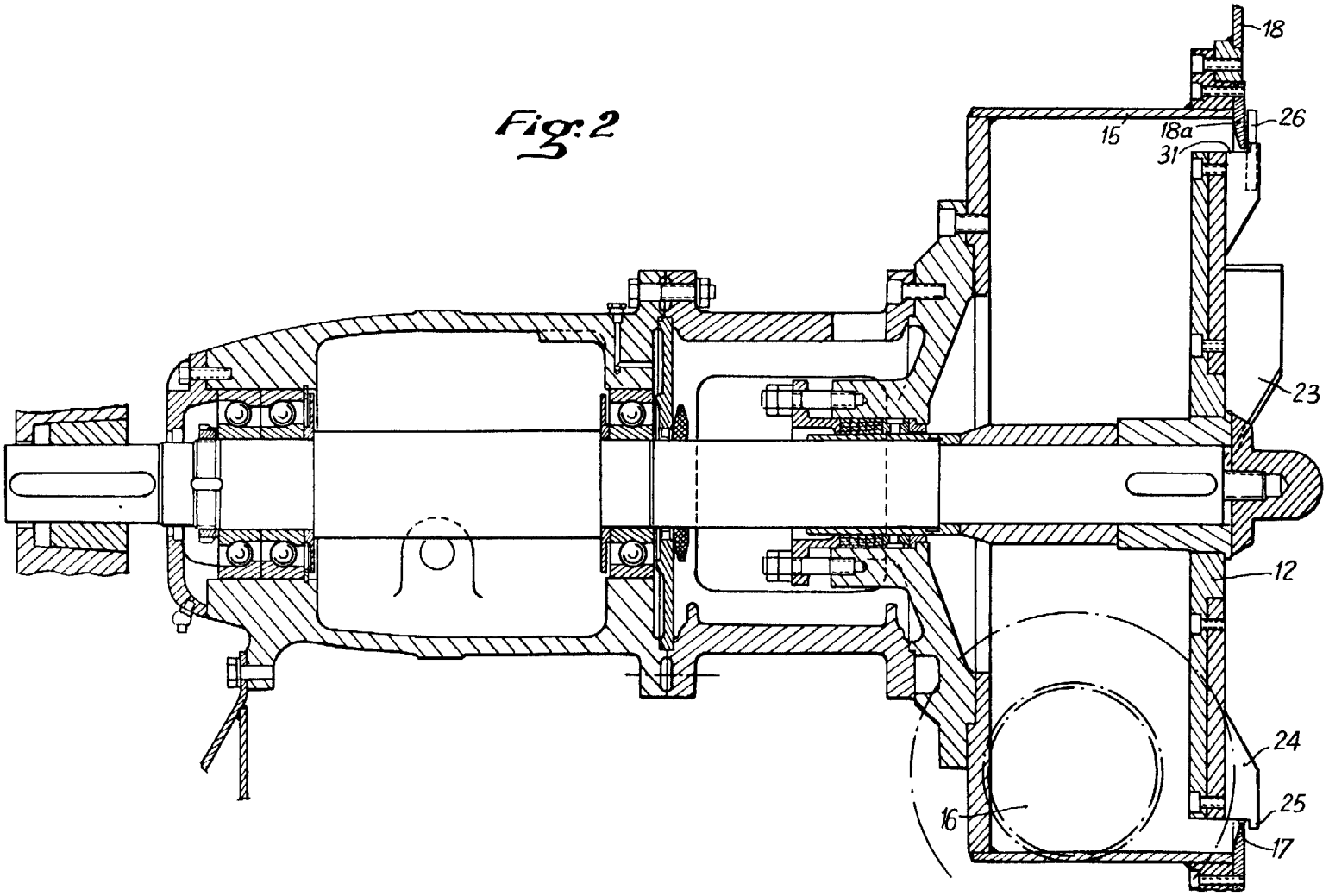
FIG. 2 is a similar partial view of an embodiment of the rotor.
Figure 4:
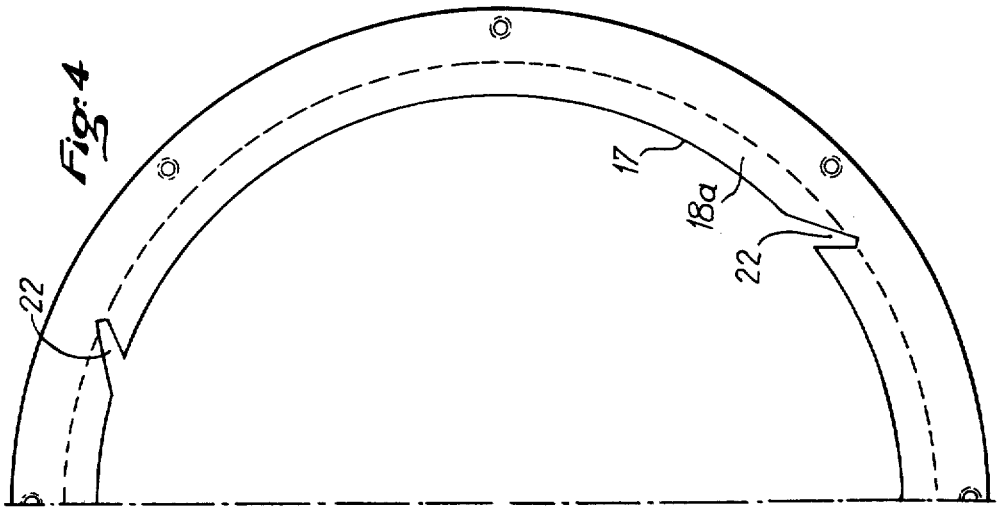
FIG. 4 is a partial plan view of the annulus 18*a* of FIG. 2.
Figure 3:
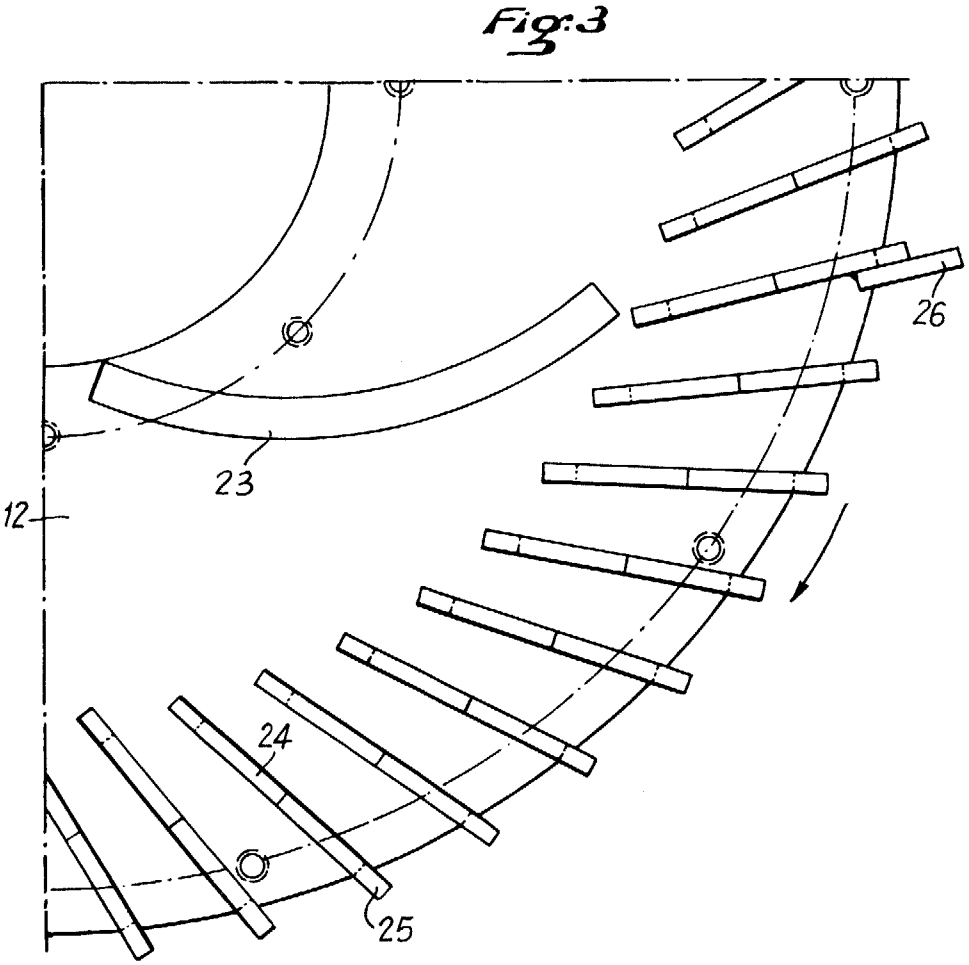
FIG. 3 is a partial plan view of the rotor of FIG. 2.
Figure 5:
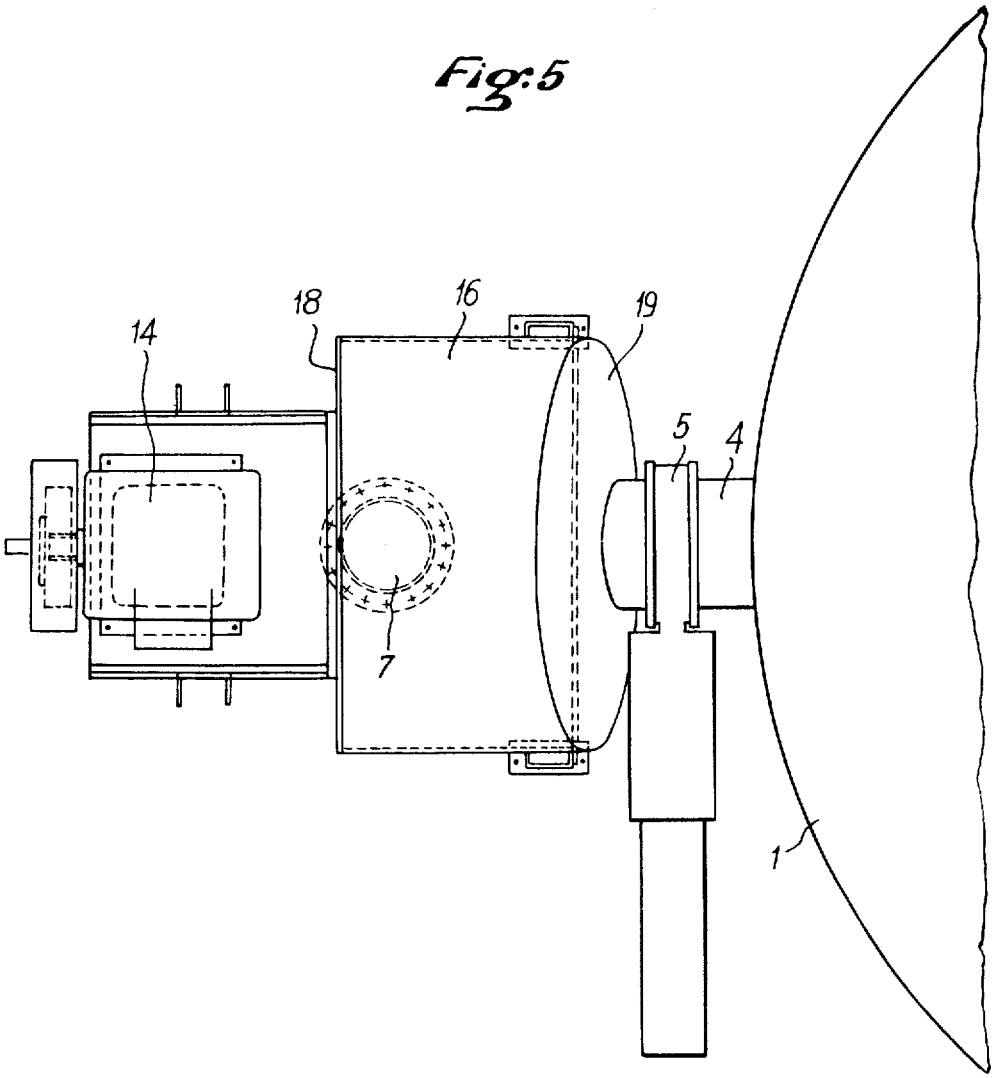
FIG. 5 is a schematic top view of the device.

In the variation of FIGS. 2, 3, and 4 the rotor plate carries centrifugal blades 23 which can be of soft steel and terminal vanes 24 made of a metal which is more resistant to wear. The vanes 24 bear terminal edges 25 which project into the opening 17. Besides this, certain vanes bear bars 26 of a very hard material, such as tool steel or tungsten carbide, these bars being fixed parallel to the annular sheet 18*a* with a very small clearance, preferably less than 1 mm. The bars 26 cooperate with grooves 22 in the shape of hollow fissures in the annular sheet 18*a* of the side 18 which surrounds the opening 17.

The fissures 22 can be radial or inclined so as to make an angle with the vanes 24.

The effect of this arrangement is as follows: When the rotor 12 turns, the impurities in the form of strips, such as pieces of plastic, shreds of string etc. arrive in the gap between the rotor plate and the opening 17, on both sides of the edge of this opening and they tend to remain stationary in this position. The clearance between the bars 26 and the grooves 22, pushes these impurities into the grooves 22 where they are cut up by a scissor effect. Some of the impurities thus reach the box 15 and they are recycled in the main pulping machine. They are thus gradually eliminated and do not pass into the pulp suspension extracted from the tub 1.

Another arrangement of the invention consists in providing a water inlet 27 near the rotor 12 in order to ensure the cleaning of the latter. This water inlet can be used when the volume 6 is empty or nearly empty to ensure the elimination of the impurities on the surface of the rotor 12 and in the gap 31. It can also be used while the volume 6 is still full if the force of the jet is sufficient to ensure this washing.

As indicated above, the pulping machine can be used for continuous or discontinuous operation.

In the case of a continuous operation, the tub 1 is constantly refilled with water and with cellulose materials and when the valve 5 is opened the hydrostatic pressure is relatively high. To avoid a sudden spattering of impurities on the rotor 12, it is preferable to fill the volume 6 with water before opening the valve 5. The suction effect of rotor 12 and the centrifugal effect of rotor 2 is sufficient to cause the introduction of the pulp charged with impurities into the volume 6.

With a discontinuous operation, it is possible on the other hand to open the valve 5 while volume 6 is empty. In fact in this type of operation, the tub 1 is half empty at least when the grating 3 begins to become obstructed, and the opening of valve 5 does not involve any risk of causing a too sudden spattering of impurities on the rotor 12. It has been stated that volume 6 is small relative to the volume of the tub 1. This point is a feature of the process and of the device of the invention.

It is possible to adapt the assembly constituted by the volume 6, the rotor 12 and their attachments on tubs 1 to very different volumes. The volume 6 will be, for example, in the region of 1 $m^3$ for the tubs 1 ranging from 10 $m^3$ to 60 $m^3$. In all these cases, the ratio of volume 6 to the ratio of volume 6 to the volume of the tub 1 is in the range of at least 1:10. Thus the filling cycle of volume 6 and the extraction cycle of the impurities causes only a very small decrease of the level of tub 1 and it is with a continuous succession of partial purifications that the pulping machine is progressively cleared of its impurities.

To take an example, if the opening phase of the valve 5 is six minutes, the phase of dilution with water by the inlet 8 after closing the valve 5 is ten minutes, the emptying phase by compressed air arising in 9 is 5 minutes and the cleansing of the impurities lasts 2 minutes, the total cycle of the process lasts 23 minutes and it can thus be repeated more than twice per hour.

Thus the process of the invention consists in putting into operation a partial extraction of pulp charged with impurities from the pulping machine, transferring it into an enclosed volume where it is stirred with the addition of water and pulp suspension extracted therefrom by a separation device until the pulp suspension is diluted to a concentration in the range of up to 1% of dry materials. The process then consists in emptying this volume, for example, by the action of compressed air, of substantially the whole suspension and finally extracting the impurities, the suspension being returned to the pulping machine.

The arrangement of the invention can be adapted to the existing pulping machines. In fact it suffices to make an opening in the bottom of the tub 1 for the association of volume 6 and of its attachments, including the channeling 16 ensuring the back flow to the tub 1. The pulper, its rotor 2 and the grating 3 are known standard devices whose construction has not been modified.

The operation in cycles can obviously be automated. An assembly of arrangements of automatic control of valves controlling the channels 4,7,8,9, 10 and 27, with the necessary time delays, as well as the operation of the motor 14 or of the arrangement for the compression of the air arriving in 9, allows an automatic cyclic operation to be ensured.

The air pressure necessary for emptying the volume 6 is low, in the range of 500 gr/$cm^2$, and can be ensured by a simple ventilator.

Different variations can be adopted in the carrying out of the invention, notably concerning the shape of volume 6 and the arrangement of rotor 12. The extraction of the suspension by the rotor 12 can be obtained by an annular, perforated side around the rotor instead of extraction through the annular gap 31 although this solution is preferred.

Nevertheless, the arrangement shown is the preferred arrangement, notably concerning the arrangement of the rotor 12 at the lower part of a nearly vertical side in relation to an outlet 7 forming the receptacle for impurities. This arrangement in fact allows the blocking of the impurities in the outlet receptacle in the course of emptying volume 6 while ensuring the cleaning of the latter by spatterings of liquid due to the operation of the rotor.

The velocities of the rotors 2 and 12 can vary greatly. They are generally in the range of from 16 to 18 m/per second at the periphery of the turbine disc.

What we claim is:

1. A combination of a pulping machine and a device for the purification of a pulp and impurities mixture contained in the pulping machine, said device comprising an enclosed chamber; valve means interconnecting said chamber and the machine for selectively charging said chamber with the mixture; means for releasably pressurizing said chamber with gas; means for adding water to said chamber; means for stirring the contents of said chamber; means for extracting the pulp from the mixture in said chamber and for returning the pulp to the machine; and means for withdrawing the remaining impurities from the chamber.

2. A device according to claim 1, wherein the volume of said chamber is not larger than one tenth of the volume of the pulping machine.

3. A device according to claim 1 wherein said enclosed chamber is of tapered cross section having a substantially horizontal axis, terminated by flat sides, one of which is substantially adjacent the pulping machine.

4. A device according to claim 3, wherein said stirring means comprises a rotor placed on the flat side opposite said one side, the axis of the chamber being at a slight inclination to the horizontal in the direction of the rotor.

5. A device according to claim 3 wherein said flat sides define an open dihedral towards the bottom of the chamber.

6. A device according to claim 4 wherein the rotor comprises a disc having vanes and being set back slightly with respect to the side on which it is placed to define an annular opening therebetween.

7. A device according to claim 6, wherein the rotor disc is set back by a distance in the range of from 5 to 10 mm.

8. A device according to claim 4, comprising means behind the rotor for collecting and returning the extracted pulp to the pulping machine, the rotor being situated at a lower part of the side on which it is placed, and said withdrawing means comprising a receptacle at the lower part of the chamber in the immediate proximity of the rotor.

9. A device according to claim 8 wherein said returning means comprises blades on a rear side of the rotor which ensure an excess pressure for recycling the pulp to the pulping machine.

10. A device according to claim 1 comprising means for ensuring the automatic cyclic operation thereof.

11. The device of claim 9 in which the pulp extracted from the chamber is collected in a volume defined by an impervious casing behind the rotor and said returning means comprises a conduit interconnecting said volume and the pulping machine.

12. The device of claim 1 in which said interconnecting means comprises a conduit situated at a lower part of the pulping machine.

13. The device of claim 6 in which said annular opening is defined by an annular ring having a plurality of generally outwardly directed grooves along its inner periphery.

14. The device of claim 13 in which said rotor disc comprises a plurality of bars overlapping said ring and cooperate with said grooves when said disc is rotated to cut impurities in said mixture.

15. The device of claim 14 in which each of said bars is mounted on one of said vanes.

* * * * *